US010903035B2

(12) United States Patent
van der Weide et al.

(10) Patent No.: US 10,903,035 B2
(45) Date of Patent: Jan. 26, 2021

(54) HIGH-FREQUENCY VACUUM ELECTRONIC DEVICE

(71) Applicants: Wisconsin Alumni Research Foundation, Madison, WI (US); University of New Mexico, Albuquerque, NM (US)

(72) Inventors: Daniel W. van der Weide, Madison, WI (US); Max Lagally, Madison, WI (US); Francesca Cavallo, Corrales, NM (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 15/918,159

(22) Filed: Mar. 12, 2018

(65) Prior Publication Data

US 2019/0279834 A1 Sep. 12, 2019

(51) Int. Cl.
*H01J 25/02* (2006.01)

(52) U.S. Cl.
CPC ..... *H01J 25/02* (2013.01)

(58) Field of Classification Search
CPC ..... H01J 25/02
USPC ..... 250/396 R, 397, 398
See application file for complete search history.

(56) References Cited

U.S. PATENT DOCUMENTS 3,916,246 A * 10/1975 Preist ..... G21K 1/093 315/5
4,571,524 A * 2/1986 Mourier ..... H01J 25/02 315/4
4,820,688 A * 4/1989 Jasper, Jr. ..... H01J 23/165 315/3.5
6,356,022 B1 3/2002 Kosmahl
6,909,235 B2 6/2005 Wolkstein et al.
6,917,162 B2 * 7/2005 Dayton, Jr. ..... H01J 23/24 315/39
7,707,714 B2 * 5/2010 Schmidt ..... H01F 17/0006 29/605
7,765,013 B2 7/2010 Blick et al.
7,973,336 B2 7/2011 Savage et al.
8,416,026 B2 4/2013 Yamakawa et al.
2012/0248979 A1 10/2012 Dayton, Jr. et al.
2017/0207522 A1 * 7/2017 Li ..... H01Q 11/08

OTHER PUBLICATIONS

Prior Art—AIP—Applied Physics Letters—Fabrication and electrical characterization of Si-based rolled up microtubes—F. Cavallo, R. Songmuang and O. G. Schmidt.
APL THZ Graphene—Cherenkov terahertz radiation from graphene surface plasmon polaritons excited by an electron beam—Tao Zhao, Min Hu, Renbin Zhong, Sen Gong, Chao Zhang and Shenggang Liu.
Gr on Ge ACS Nano 8 10237-10245 2014—Exceptional Charge Transport Properties of Graphene on Germanium—Francesca Cavallo, Richard Rojas Delgado, Michelle M. Kelly, Jose R. Sanchez Perez, Daniel P. Schroeder, Huili Grace Xing, Mark A. Eriksson and Max G. Lagally.
International Search Report for Internatioinal Application No. PCT/US2019/020957 dated Jun. 14, 2019.

* cited by examiner

*Primary Examiner* — Michael Maskell
(74) *Attorney, Agent, or Firm* — Boyle Fredrickson, S.C.

(57) ABSTRACT

A self-assembling element fabricated using integrated circuit techniques may provide a small diameter helical conductor surrounding an electron beam for the construction of a vacuum electronic device such as a traveling-wave tube for terahertz scale signal.

24 Claims, 5 Drawing Sheets

HIGH-FREQUENCY VACUUM ELECTRONIC DEVICE

STATEMENT REGARDING FEDERALLY SPONSORED RESEARCH OR DEVELOPMENT

This invention was made with government support under DE-FG02-03ER46028 awarded by the US Department of Energy. The government has certain rights in the invention.

CROSS REFERENCE TO RELATED APPLICATION

--

BACKGROUND OF THE INVENTION

The present invention relates to vacuum electronic devices employing an interacting electron beam and electromagnetic wave (such as in a traveling-wave tube) and in particular such devices providing extremely high-frequency operation.

Terahertz electromagnetic waves have a frequency that lies between microwaves and infrared light. The production and amplification of terahertz electromagnetic radiation may prove important in a variety of technologies including imaging, spectroscopy, and data communication; however, the ability to produce compact and robust devices producing terahertz radiation in meaningful power levels (milliwatts or higher) is elusive.

One potential candidate for terahertz-level electromagnetic amplification is the traveling-wave tube, being a class of vacuum electronic devices (VEDs) that generally includes klystrons, magnetrons, gyrotrons, and backward-wave oscillators, among other devices. Each of these vacuum electronic devices converts the kinetic energy of an accelerated electron beam into electromagnetic-field energy.

A typical traveling-wave tube provides a helical conductor along which an electromagnetic wave is guided. An accelerated electron beam is directed to the center of the helix, along the axis of the helix. The helix reduces the speed of the electromagnetic wave, measured in the direction of the electron beam, to match that of the electron beam (by increasing the path length of the electromagnetic wave along the helix compared with the path length of the beam) and also provides close proximity between the electromagnetic wave and the electron beam, promoting energy transfer from the beam to the electromagnetic field.

A challenge in producing a traveling-wave tube in the terahertz range is the small size of the helix required for these frequencies that must be precisely fabricated and aligned with an electron beam.

SUMMARY OF THE INVENTION

The present invention provides a vacuum electronic device such as a traveling-wave tube that employs a self-assembled helical conductor, for example, formed by a conductor applied to a thin layer of material subject to differential strain, causing that material to coil into a helix. By control of the conductor properties, including thickness, elastic modulus, and built-in strain, small but precisely-defined helices can be generated.

More specifically, the invention provides a vacuum electronic device having a housing defining a cavity supporting a vacuum and holding an electron source for generating a beam of electrons directed along an axis through the cavity.

A helical conductor, positioned to spiral about the axis, includes a strip with a stress gradient causing it to relax to form the helix. A coupler directs an electromagnetic signal into the helical conductor for amplification of that signal by a transfer of energy from the electron beam to the electromagnetic signal in the helical conductor.

It is thus a feature of at least one embodiment of the invention to provide extremely small-scale but precisely defined helices useful for structures such as traveling-wave tubes by the self-assembly mechanism of releasing stress.

The strip may provide a differential stress along a nonzero angle with respect to a longest dimension of the extent of the strip when flat to promote self-assembly of a linear strip into a helical form.

It is thus a feature of at least one embodiment of the invention to provide a helical support or conductor having controlled pitch and/or diameter suitable for helical conductors used in devices such as traveling-wave tubes for THz radiation.

The prestressed strip may be a crystalline material that has a longest dimension extending at a nonzero angle with respect to the <100> axis.

It is thus a feature of at least one embodiment of the invention to make use of anisotropic mechanical properties of the crystalline or noncrystalline lattice structures of the film and of the substrate to achieve helices.

The strip may be at least two layers of different materials having different lattice constants.

It is thus a feature of at least one embodiment of the invention to provide great flexibility in the ability to generate differential stresses through the use of different materials.

Alternatively, the strip may be a single material having stress whose magnitude changes (a stress gradient) as one moves in a direction parallel to the thickness.

It is thus a feature of at least one embodiment of the invention to provide a simple fabrication method using a single material with internal stress gradation.

The helical conductor may further include a conductive material attached to the strip so that the conductive material is formed into a helix by relaxing of the strip.

It is thus a feature of at least one embodiment of the invention to provide the ability to optimize conductance separate from the structural considerations of the helical strip.

The conductive material may be graphene.

It is thus a feature of at least one embodiment of the invention to provide a highly conductive material that can be readily deformed into the helix.

The strip may provide a germanium surface supporting the graphene.

It is thus a feature of at least one embodiment of the invention to provide a substrate for the graphene that promotes high conductivity.

The strip may include a second prestressed material relaxing to form a conductive cylinder.

It is thus a feature of at least one embodiment of the invention to provide a rolled-up conductor that may reduce edge roughness causing charge scattering at terahertz frequencies.

The conductive cylinder 1 may have a diameter less than half a diameter of the helix.

It is thus a feature of at least one embodiment of the invention to provide a conductor that minimizes interference with the formation of a helix.

The helical conductor may be passivated at its edges generally normal to the axis.

It is thus a feature of at least one embodiment of the invention to reduce the effects of edge trap states that can cause charge scattering.

The coupler may include a first and second waveguide position perpendicular to the axis at opposite ends of the helical conductor.

It is thus a feature of at least one embodiment of the invention to provide a simple method of connecting the helix to an external device without the need for complex physical connection.

The helix may have a diameter of less than 12 microns and in some cases less than three microns.

It is thus a feature of at least one embodiment of the invention to provide extremely small helical conductors that are believed to produce a better coupling between the electron beam and the helix for extremely high frequencies.

The helix may be supported on a substrate using spaced-apart substrate supports to bridge between the substrate supports with unsupported spans of the helix.

It is thus a feature of at least one embodiment of the invention to provide a simple alignment and support system for the helix that can be integrated with other components manufactured on the same substrate, including the electron source and collector.

The prestressed bilayer strip may be a crystalline material that has a longest dimension extending at a nonzero angle with respect to the most compliant crystalline direction (in the diamond lattice, e.g., for Si and Ge, the <100> axis), and the substrate supports may be spaced along a substrate separation axis angled with respect to this most compliant direction (in this example the <100> axis).

It is thus a feature of at least one embodiment of the invention to position the substrate supports (or posts) so that the strips automatically assemble to the posts as the strips form into helices.

The helix may have an increasing diameter in the direction of electron travel of the electron beam.

It is thus a feature of at least one embodiment of the invention to accommodate electron beam diameter expansion as the electron beam moves through the helix, a factor that is expected to be more pronounced at smaller beam diameters needed for these nanohelices.

Alternatively, or in addition, the helix has an increasing pitch in the direction of travel of the electron beam.

It is thus a feature of at least one embodiment of the invention to accommodate slowing of the electron beam as it releases energy by producing a parallel slowing of the electromagnetic wave (measured along the axis) for improved coupling efficiency.

These particular objects and advantages may apply to only some embodiments falling within the claims and thus do not define the scope of the invention.

DETAILED DESCRIPTION OF THE PREFERRED EMBODIMENT

Figure 1:
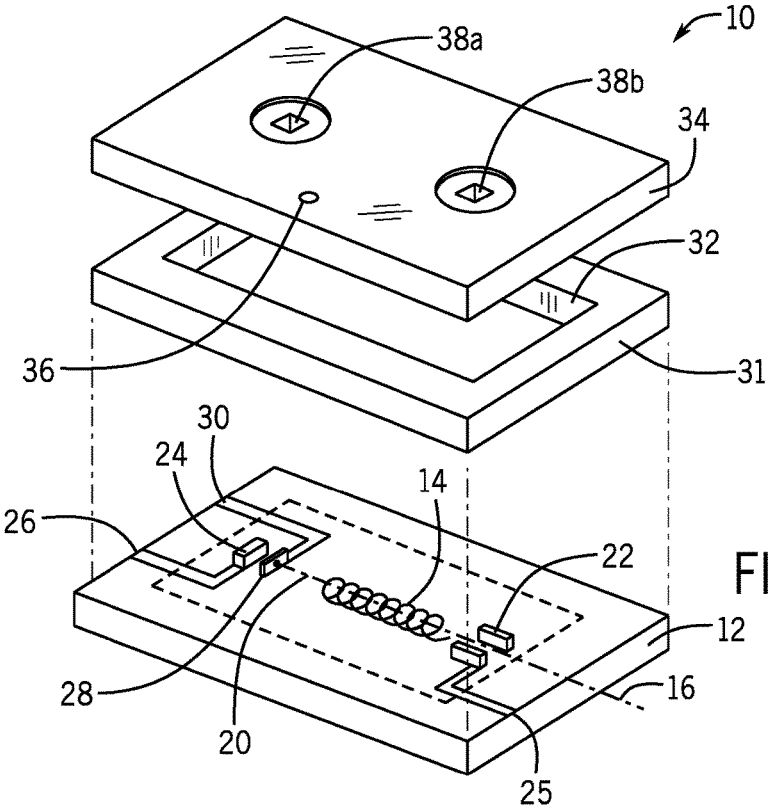
FIG. 1 is a is a simplified exploded perspective view of the traveling-wave tube per the present invention produced by a set of assembled wafers fabricated using integrated circuit techniques.
Figure 2:
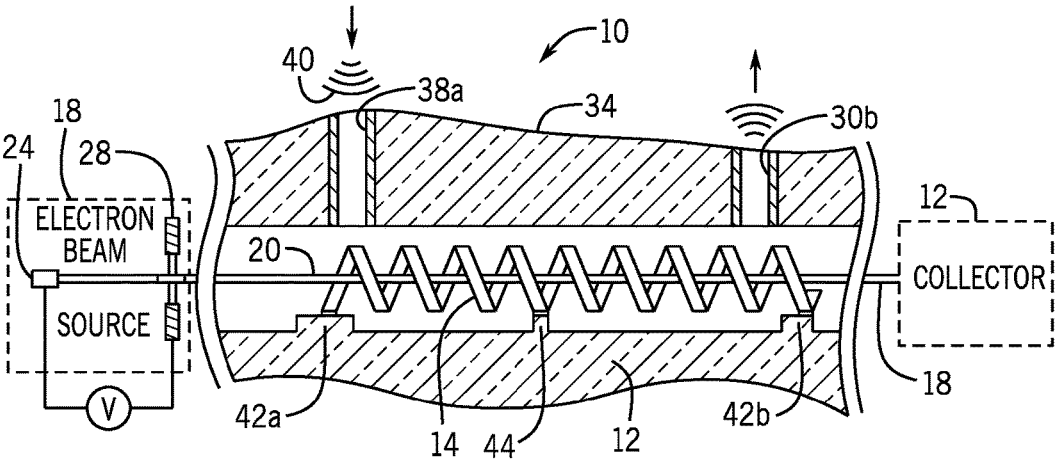
FIG. 2 is a cross-sectional view along line 2-2 of FIG. 1 showing a self-assembled helical conductor positioned around the electron beam per the present invention.

Referring now to FIGS. 1 and 2, a vacuum electronic device 10 in an embodiment of the traveling-wave tube may be constructed on a planar substrate 12 using standard integrated circuit techniques. The planar substrate 12 may support a helical conductor 14 extending along an axis 16 coplanar with the upper surface of the substrate 12 fabricated on that substrate as will be described below.

Disposed at a first end of the helical conductor 14 along axis 16 is an electron beam source 18 directing an electron beam 20 along the axis 16 concentrically within the helical conductor 14. The opposite end of the helical conductor 14 provides electron collector 22, collecting and dissipating residual energy in the electron beam 20 after passing through the helical conductor 14.

The electron beam source 18 may provide a cathode 24 connected to a source of negative voltage through conductive trace 26 and operates to emit electrons (for example, by field emission) accelerated through an anode 28 positively charged with respect to the cathode 24 through trace 30. Traces 26 and 30 may connect with a high-voltage source (not shown).

The electron beam source 18 and cathode 24 may also be fabricated using integrated circuit techniques or may be implemented through an external device such as a scanning electron microscope. The generation of small electron beams using field emission for integrated circuit-scale vacuum devices is described, for example, in U.S. Pat. No. 7,736,210 assigned to the assignee of the present invention and hereby incorporated by reference. It is contemplated that the invention may alternatively use other known electron beam formation techniques.

The electron collector 22 requires relatively low precision and may adopt conventional designs scaled for the integrated circuit fabricated directly on the substrate 12. Generally, the electron collector 22 is biased to be positive in voltage with respect to the cathode 24 through trace collector 25 (which may be attached to trace 30) to attract electrons and sized to absorb necessary heat energy of those electrons, for example, by an extended length or the use of baffles and fins or the like.

A second planar substrate 31 may be positioned over the substrate 12 and may have been processed to provide a cutout forming part of a cavity 32 that may hold the helical conductor 14 as well as the electron beam source 18 and electron collector 22 providing upstanding walls thereabout.

A third capping substrate 34 may then be placed over top of substrate 31 so that cavity 32 becomes an enclosed volume. The substrates 12, 31, and 34 as depicted may be laminated face-to-face and sealed together, for example, by a fusible frit or adhesive to support a vacuum in the cavity 32 which may be evacuated, for example, through an evacuation port 36 in substrate 34.

The substrate 34 may also include preformed first and second couplers 38*a* and 38*b* providing metallized channels (for example, using etching and metallization processes known in integrated circuit construction) forming waveguides at terahertz frequencies and extending perpendicularly to axis 16 so that their axes intersect axis 16 at opposite ends of the helical conductor 14.

Referring now to FIG. 2, terahertz radiofrequency energy 40 may be introduced into coupler 38*a* for amplification by the vacuum electronic device 10. This terahertz radiofrequency energy 40 is introduced to couple to the helical conductor 14 and within the helical conductor 14 is conducted along the helix to be emitted through coupler 38*b* as an amplified signal, amplified by the vacuum electronic device 10. As is generally understood in the art, the helical conductor 14 provides a propagation of the radiofrequency energy 40 along axis 16 that matches the speed of electron flow in the electron beam 20 allowing a coupling between these two forms of energy through slight bunching of the electrons of the electron beam 20. This bunching facilitates the transfer of energy from the electron beam 20 imparted by the acceleration between the cathode 24 and the anode 28 into the radiofrequency energy 40 of the helix. Close proximity of the helical conductor 14 and the electron beam 20 is necessary for proper coupling with the small-beam field variations.

In one embodiment, opposite ends of the helical conductor 14 maybe supported on insulating standoffs 42*a* and 42*b* formed to project upward from the surface of substrate 12 after processing as will be discussed further below. A central standoff 44 of similar height may also be placed to support the helical conductor 14 to promote vibration resistance or to be electrically conductive to enforce boundary conditions, for example, to block a backward wave or the like. More generally the helical conductor 14 is expected to be sufficiently stiff to bridge the distance between the insulating standoffs 42*a* and 42*b* without further support.

Figure 3A:
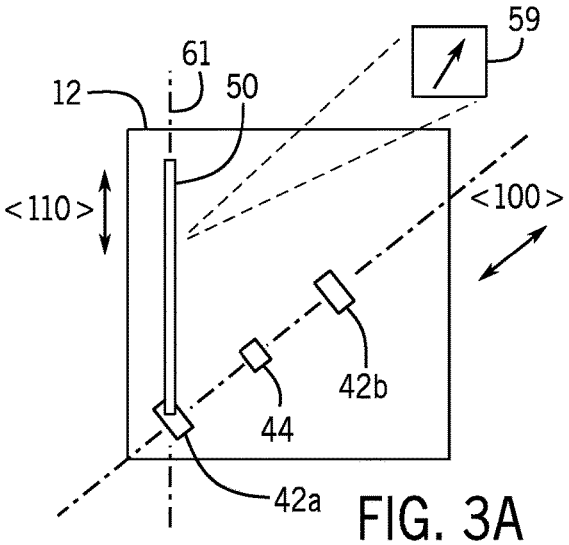
FIGS. 3*a* and 3*b* are top plan views of an integrated circuit substrate showing the layout of a strip before and after its release, respectively, to form a helical conductor.
Figure 4A:
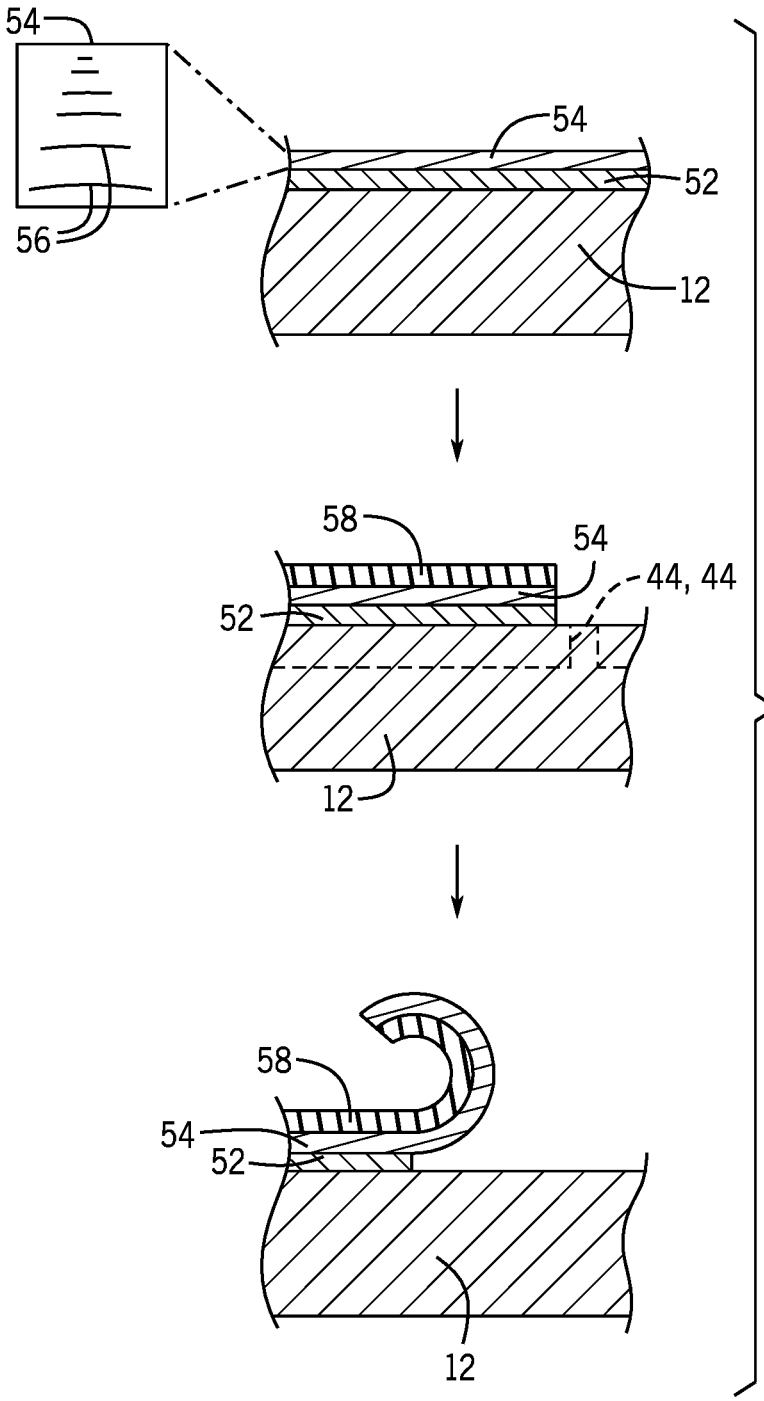
FIGS. 4*a* and 4*b* are process diagrams showing a fragmentary elevational cross-section of the substrates of FIGS. 3*a* and 3*b* in two processing alternatives using, respectively, a single material of graduated stress or a differentially stressed bilayer.

Referring now to FIGS. 3*a* and 4*a*, the helical conductor 14 may be fabricated using a self-assembly technique in which a linearly extending strip 50 of material is fabricated on the substrate 12 in a way so as to be prestressed in the flat state in order to elastically transform from a linear extent to the desired helical dimensions (diameter, pitch, and length) when released from the substrate. General techniques for fabricating such a helix are described in Minghuang Huang, et al., Nanomechanical Architecture of Strained Bilayer Thin Films: From Design Principles to Experimental Fabrication December 2005 Advanced Materials 17(23): pages 2860-2860, hereby incorporated by reference describing a state-of-the-art with respect to producing helices using differential lattice strain in thin sheets.

In a first embodiment, the substrate 12 may have an upper surface comprised of a p-doped silicon crystal having a given lattice constant representing generally the spacing periodicity of the crystalline surface. A crystalline layer of intrinsic or lightly doped silicon (i-Si) 52 may be grown over the top of the substrate 12 (having essentially the same lattice constant) by molecular beam epitaxy or similar process.

Next, a germanium layer 54 is epitaxially grown over the top of i-Si layer 52 at a relatively low temperature (T~350° C.) on the (001) face of the Si substrate crystal. Because of the different lattice constants of germanium layer 54 with respect to the i-Si layer 52, the crystal structure of the germanium layer 54 in contact with the i-Si layer 52 will be stressed, indicated in simplified form by lines of relative stress 56. As each successive layer of germanium atoms is applied to the germanium layer 54, the epitaxial strain will be reduced as indicated resulting in a differentially stressed germanium layer 54. The strain gradient across the thickness of the germanium layer can be tailored by adjusting the growth rate and temperature. Specifically, in one example, one can grow Ge on Si above the critical thickness so that, after a first thickness (e.g., 4 monolayers (ML)), where the strain is uniform, the strain decreases when additional layers are grown, due to plastic relaxation. Growth at low temperature is needed (1) to "freeze" the strain gradient across the thickness, and (2) to keep the growth two-dimensional above the critical thickness. The above described processing may all occur along the plane of the substrate 12 allowing standard integrated circuit techniques to be employed.

Figure 3B:
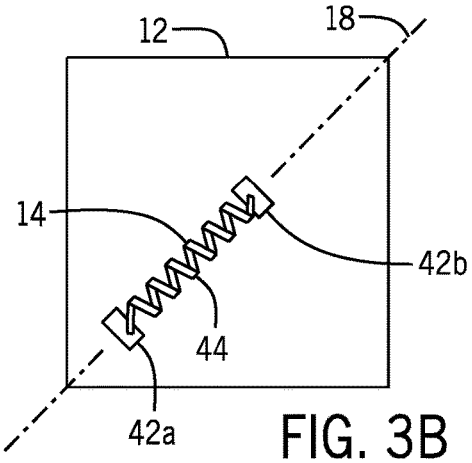

The combined layers of the i-Si layer 52 and the germanium layer 54 may then be trimmed, for example, by masking and ion etching or other techniques known in the art to form the outline of the strip 50 shown in FIG. 3*b*. At this point strip 50 is well-defined as indicated by FIG. 3*a* extending along the <110> crystallographic direction. Generally, the strip 50 will be oriented at a nonzero angle from the crystallographic <100> axis, in crystal structures, such as those, such as those of Si or Ge, in which the <100> axis is the mechanically "soft" direction.

At the same time, other surfaces of the substrate 12 may be etched to generate the standoffs 42 and 44 described above. It will be understood that desired different materials may be used to create the standoffs 42 and 44, for example, by etching pockets in the substrate 12 and filling them with materials and then etching around those materials.

At a succeeding step, a conductor layer 58 may optionally be applied over the germanium layer 54 to improve electrical conduction or if a material operating in the capacity of the germanium layer 54 is not conductive. In one embodiment this conductor layer 58 may be graphene which provides improved conductive properties when coated on germanium. See generally, Francesca Cavallo, et al. Exceptional Charge Transport Properties of Graphene on Germanium, ACS Nano. 2014 Oct. 28; 8(10):10237-45 hereby incorporated by reference. The conductor layer 58 will normally be bonded to the germanium layer 54 in planar configuration before it is assembled into a helix. Generally, the helical conductor 14 must be conductive at the desired radiofrequency but need not have a long mean free path of electron conduction at terahertz frequencies.

In order to improve the conductivity of the conductor layer 58 (or the germanium layer 54 used as a conductor) these layers may be subject to passivation, for example, serving to inactivate broken bonds of the semiconductor surface by saturation with a reactive material such as hydrogen or by formation of an oxide. It is believed that this process may limit depletion of carriers in the conductor and thus enhance conductance. The conductor layer 58 and/or the germanium layer 54 may also be annealed to reduce edge roughness.

Finally, the i-Si layer 52 may then be etched away as a sacrificial layer, for example, by KOH or $NH_4OH$ which selectively attacks the i-Si layer 52 compared to the respective p-type Si substrate 12. The stresses 56 within the germanium layer 54 cause the germanium layer 54 and conductor layer 58 to roll about a cylindrical volume and to progress helically about that cylindrical volume depending on the angle of the net stress 59 compared to an axis of longest extent 61 of the strip 50. As shown in FIG. 3*b*, in this process the helix extends toward the softest crystal direction (i.e., <100> for Si or Ge). By varying this angle, the helix pitch can be controlled, and by varying the amount of differential stress and thickness of the germanium layer 54, the helix diameter can be controlled. Generally, the inventors contemplate that the diameter the helix will be less than 24 microns and for particular applications less than 12 microns or preferably less than three microns or as little as less than one micron.

Figure 4B:
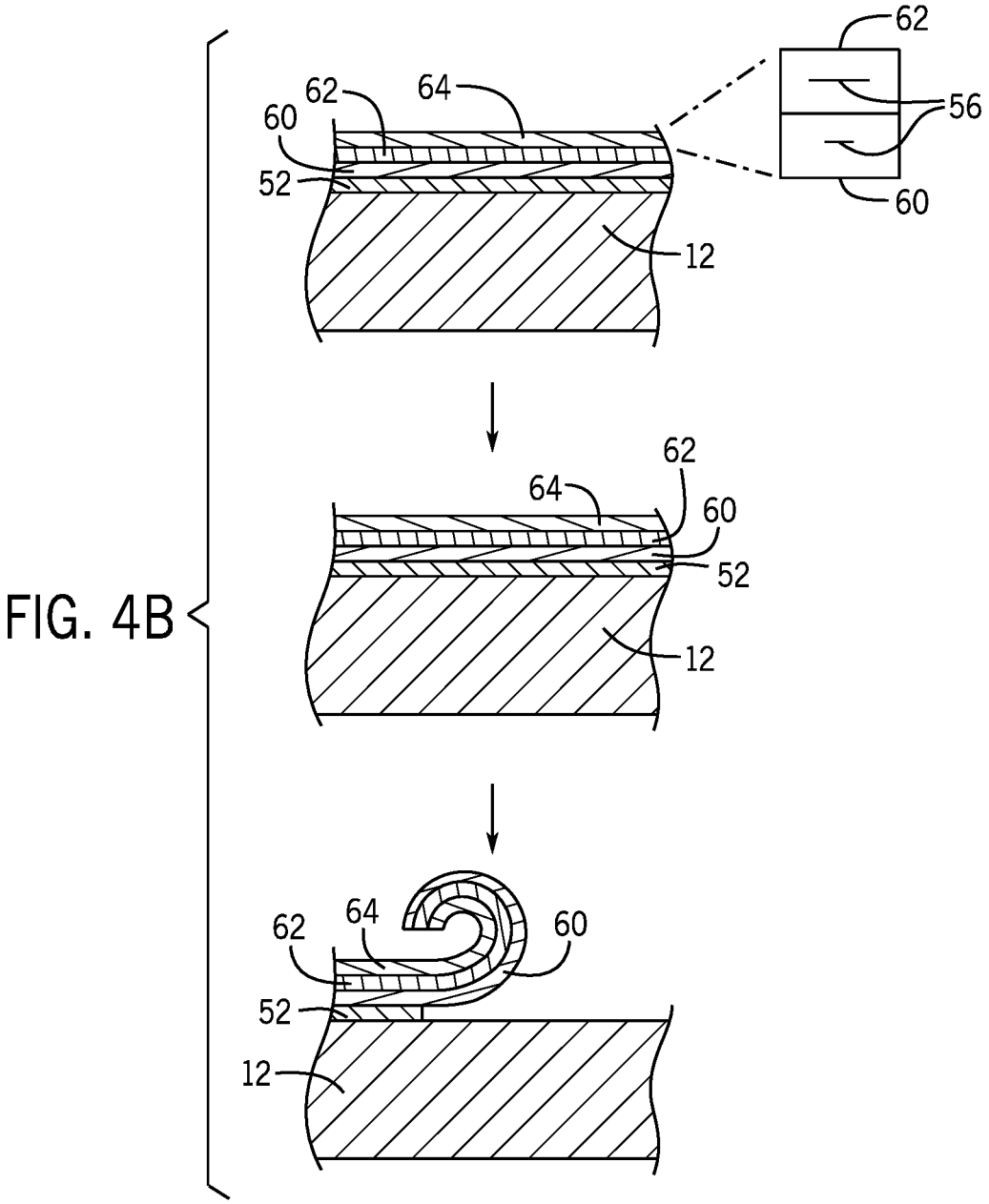
Figure 8:
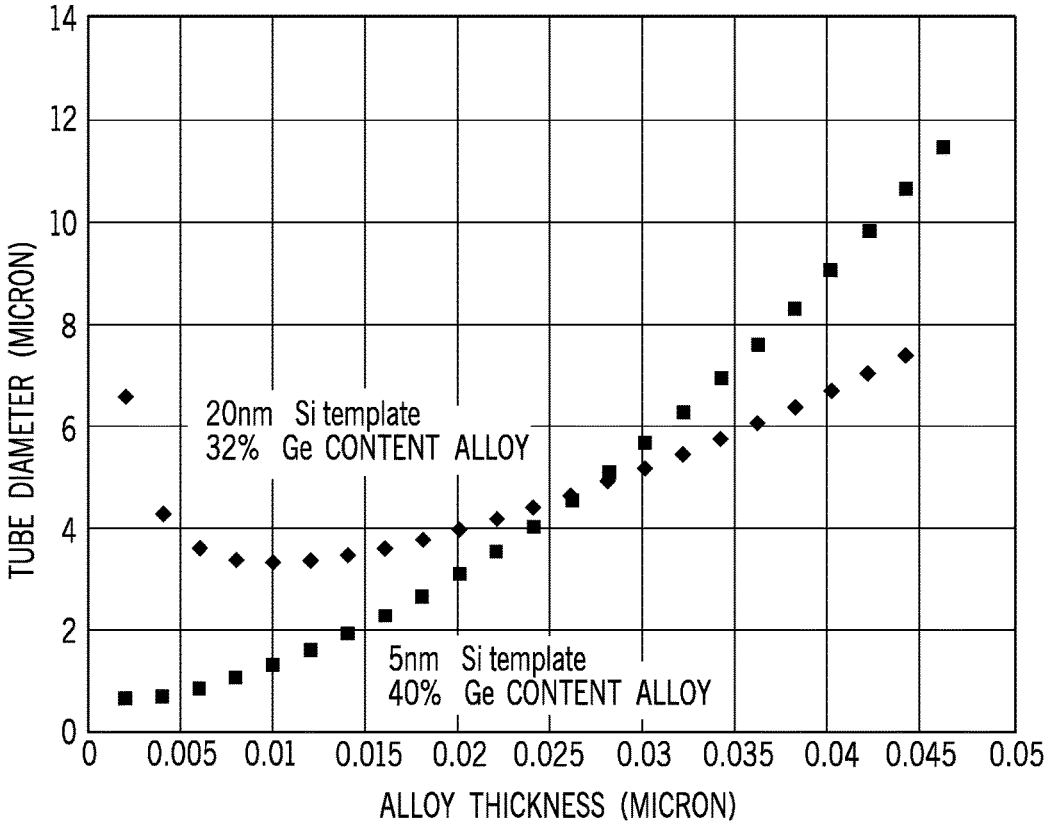
FIG. 8 is a chart showing achievable helical diameters obtained with the process of FIG. 4*a* for two specific combinations of epitaxially grown materials, Si and SiGe, and for varying thickness of one layer while the second-layer thickness is fixed.

Referring now to FIGS. 3 and 4*b*, in an alternative embodiment, the substrate 12 may again have a sacrificial i-Si layer 52 but this latter surface may be coated with two different materials of layers 60 and then layer 62, these materials having different lattice constants. For example, layers 60 and 62 may provide respectively a bilayer of pure silicon and a silicon germanium alloy, for example, as taught by Huang et al., Advanced Materials, Volume 17, Issue 23, 2005, Pages 2860-2864, hereby incorporated by reference. FIG. 8 shows calculated helix diameters for bilayers with various Si/Ge alloy compositions. It will be appreciated that other materials and combinations may be used in the bilayers as is generally understood in the art.

The combined thickness of layers 60 and 62, for example, may be on the order of 110 nanometers and provide the helix with a radius of 2.4 micrometers and a ribbon width of two micrometers. By varying the bilayer thickness from 10 nanometers to 200 nanometers, helix diameters of 20 nanometers to 100 micrometers can be obtained.

In this example, layer 62 may be again coated with an alternative conductor 64 such as graphene, eliminating the need for high-conductivity properties in the differentially strained materials. As indicated in FIG. 4*b*, each of the layers 60 and 62 may exhibit different stresses 56 caused by their relatively different lattice constants producing the same self-assembly rolling when the sacrificial i-Si layer 52 is removed per FIG. 3*b*.

Referring again to FIGS. 3*a* and 3*b*, the standoffs 42 and 44 may be fabricated to the side of the strip 50 so as to be properly positioned under the helical conductor 14 when the strip 50 rolls into the position as shown in FIG. 3*b*.

Figure 5:
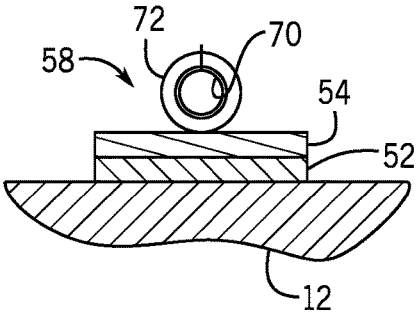
FIG. 5 is a cross-sectional view perpendicular to the length of the strip in an alternative embodiment employing a tubular conductor attached to the strip.

Referring now to FIG. 5, in either of the embodiments of FIGS. 4*a* and 4*b* (but shown with respect to FIG. 4*a*), the conductor layer 58 may be formed by a combination of a conductive material such as graphene 70 applied to a prestressed substrate 72 (in a planar form) which after coating with graphene 70 may be released by a sacrificial layer (similar to that described above) causing the substrate 72 to roll into a cylinder bringing edges of graphene 70 into close proximity. It is thought that this form factor and proximity may provide for improved conduction and reduced scatter at terahertz frequencies practically overcoming the problems of edge roughness of the conductive layer (graphene 70) such as can interfere with the transmission of electromagnetic signals in the terahertz range.

Figure 6:
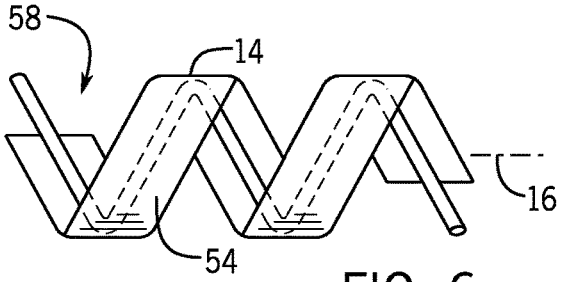
FIG. 6 is a perspective view of the helical conductor formed from the strip of FIG. 5.

As shown in FIG. 6, with release of i-Si layer 52 per the processes shown in FIG. 4, the tubular conductor layer 58 is formed into a helix producing the helical conductor 14 by the force exerted by the strain gradient in germanium layer 54 or the bilayer of layers 60 and 62.

Figure 7:
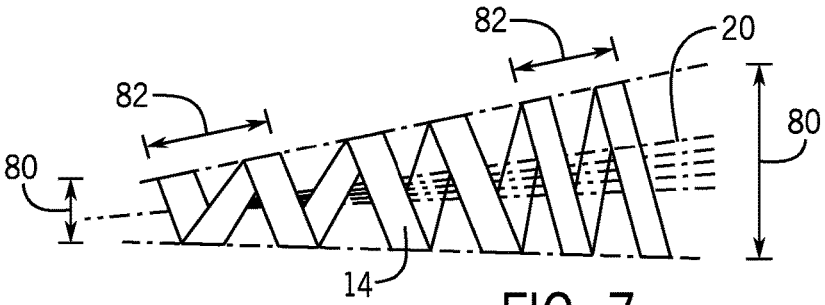
FIG. 7 is a view similar to that of FIGS. 2 and 6 of an embodiment of the helical conductor providing increased diameter and increased pitch along the path of the electron beam to better match the changing characteristics of the contained electron beam.

Referring now to FIG. 7, the diameter of the helical conductor 14 may be controlled, for example, as indicated above with the discussion of FIG. 8 or by increasing the thickness or strain in the strip 50 in a manner that varies along the length of the strip 50 shown in FIG. 3*a*, so as to change one or both of the diameter 80 of the helix along the length of the helical conductor 14 or its pitch 82, for example. Ideally, this diameter 80 and pitch 82 are adjusted to match the increasing diameter of the electron beam 20 as it becomes defocused subject to internal self-repulsion and the slower speed of the electron beam 20 as energy is removed from it. The change in the dimensions of the helical conductor 14 allow the effective speed of the propagating electromagnetic signal to also slow and/or maintain a substantially constant relationship with the electron beam.

It will be appreciated that when the strip 50 is formed as a bilayer, the two layers may both comprise crystalline materials, or one may be crystalline and one amorphous, for example a film bonded to a crystalline layer. Two amorphous layers are also possible.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A vacuum electronic device comprising:

a housing defining a cavity supporting a vacuum;

an electron source for generating a beam of electrons directed along an axis through the cavity;

a helical conductor spiraling about the axis and including a strip presenting a stress gradient along its thickness when flat, the stress gradient causing the strip to relax to form a helix of the helical conductor, the strip having edges flanking the helical conductor to also spiral about the axis when the strip relaxes to form the helix; and a coupler directing an electromagnetic signal into the helical conductor for amplification of the electromagnetic signal by a transfer of energy from the electron beam to the electromagnetic signal in the helical conductor.

2. The vacuum electronic device of claim 1 wherein the strip provides a differential stress along a non-zero angle with respect to a longest dimension of the extent of the strip when flat to promote self-assembly of a linear strip into a helical form.

3. The vacuum electronic device of claim 2 wherein the strip is a crystalline material that has a longest dimension extending at a nonzero angle to an axis of the crystalline materials with a lowest flexural rigidity.

4. The vacuum electronic device of claim 2 wherein the prestressed strip is a bilayer of two different materials having different stresses when flat.

5. The vacuum electronic device of claim 2 wherein the strip is a single material having a monotonically increasing or decreasing stress gradient as one moves along a thickness perpendicular to the longest extent of the uniform material.

6. The vacuum electronic device of claim 2 wherein the strip is at least two layers of different materials having different lattice constants.

7. The vacuum electronic device of claim 1 wherein the helical conductor further includes a conductive material attached to the strip for deforming into a helix by relaxing of the prestressed strip.

8. The vacuum electronic device of claim 7 wherein the conductive material is graphene.

9. The vacuum electronic device of claim 8 wherein the strip provides a germanium surface supporting the graphene.

10. The vacuum electronic device of claim 7 wherein the strip includes a second material relaxing to form a conductive cylinder.

11. The vacuum electronic device of claim 10 wherein the conductive cylinder has a diameter less than half a diameter of the helix.

12. The vacuum electronic device of claim 1 wherein the helical conductor is passivated at its edges generally normal to the axis.

13. The vacuum electronic device of claim 1 wherein the coupler includes a first and second waveguide position perpendicular to the axis at opposite ends of the helical conductor.

14. The vacuum electronic device of claim 1 wherein the helix has a diameter of less than 12 microns.

15. The vacuum electronic device of claim 1 wherein the helix has a diameter of less than three microns.

16. The vacuum electronic device of claim 1 wherein the helix is supported on a substrate at spaced-apart substrate supports to bridge between the substrate supports at unsupported spans.

17. The vacuum electronic device of claim 16 wherein the prestressed strip is a crystalline material that has a longest dimension extending at a nonzero angle with respect to an axis of lowest flexural rigidity of the crystalline material and wherein the substrates supports are spaced along the substrate along a separation axis aligned with this axis of lowest flexural rigidity.

18. The vacuum electronic device of claim 1 wherein the helix has an increasing diameter in a direction of electron travel of the electron beam.

19. The vacuum electronic device of claim 1 wherein the helix has an increasing pitch in a direction of electron travel of the electron beam.

20. The vacuum electronic device of claim 19 wherein the stress gradient changes as one moves along a longest dimension of the strip.

21. A method of fabricating a vacuum electronic device of a type having:

a housing defining a cavity supporting a vacuum;

an electron source for generating a beam of electrons directed along an axis through the cavity;

a helical conductor spiraling about the axis and including a prestressed strip relaxing to form a helix of the helical conductor, the strip having edges flanking the helical conductor to also spiral about the axis when the strip relaxes to form the helix; and a coupler system for coupling an electromagnetic signal into the helical conductor for amplification by a transfer of energy from the electron beam to the electromagnetic signal in the helical conductor, the method comprising:

(a) applying a sacrificial layer to a substrate;

(b) applying at least one strip material to the sacrificial layer having a stress gradient when attached to the sacrificial layer to create a prestressed strip; and (c) separating the strip layer from the sacrificial layer to form the helical conductor.

22. The vacuum electrical device of claim 1 wherein the helical conductor has a constant radius about the axis.

23. The vacuum electrical device of claim 1 wherein the material of the strip is exclusively outside of the conductor with respect to the axis.

24. The vacuum electrical device of claim 1 wherein the strip has a substantially constant width perpendicular to an extent of the helical conductor and the constant width is no greater than the helical pitch so that the strip does not overlap itself when it relaxes to form a helix.

* * * * *